US007946057B2

(12) United States Patent
Dittmer et al.

(10) Patent No.: US 7,946,057 B2
(45) Date of Patent: May 24, 2011

(54) CLOTHES DRYER

(75) Inventors: Lothar Dittmer, Berlin (DE); Holger Löffler, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 868 days.

(21) Appl. No.: 11/886,400

(22) PCT Filed: Jan. 9, 2006

(86) PCT No.: PCT/EP2006/050084

§ 371 (c)(1),
(2), (4) Date: Sep. 13, 2007

(87) PCT Pub. No.: WO2006/097364

PCT Pub. Date: Sep. 21, 2006

(65) Prior Publication Data

US 2008/0189974 A1 Aug. 14, 2008

(30) Foreign Application Priority Data

Mar. 18, 2005 (DE) ..... 10 2005 013 052

(51) Int. Cl.
*F26B 7/00* (2006.01)

(52) U.S. Cl. ..... 34/603; 34/597; 34/601; 34/85; 8/442; 8/137; 68/20; 68/38 C; 705/1; 705/14; 706/1

(58) Field of Classification Search ..... 34/603.597, 34/85, 601; 8/442, 137; 68/20, 38 C; 705/1, 705/14; 706/1
See application file for complete search history.

(56) References Cited

U.S. PATENT DOCUMENTS

| | | | | | |
|---|---|---|---|---|---|
| 1,427,580 | A | * | 8/1922 | Collins | 34/82 |
| 2,114,776 | A | * | 4/1938 | Davis | 68/18 R |
| 2,142,042 | A | * | 12/1938 | Bowdoin et al. | 34/486 |
| 2,460,422 | A | * | 2/1949 | Koppel | 34/606 |
| 2,503,329 | A | * | 4/1950 | Geldhof et al. | 34/604 |
| 2,517,421 | A | * | 8/1950 | Geldhof | 432/117 |

(Continued)

FOREIGN PATENT DOCUMENTS

DE 31 35 292 3/1983

(Continued)

OTHER PUBLICATIONS

International Search Report PCT/EP2006/050084.

*Primary Examiner* — Stephen M. Gravini
(74) *Attorney, Agent, or Firm* — James E. Howard; Andre Pallapies

(57) ABSTRACT

A support structure for a clothes dryer comprising modular units for receiving functional parts and an air duct components. The modular units are incorporated into the support structure. The inventive support structure for stabilizing the clothes dryer comprises a front part in the form of a combined body provided with an end shield, a front wall, a base module on the bottom side comprising a base body and a process air lid, a rear module comprising the rear wall, a heating device and a cover. The joining surfaces between the modular units are located on a vertical plane. Connections are constructed in such a way that they are devoid of sealing elements which are currently used for joining surfaces. With respect to known embodiments, the inventive clothes dryer structural design is producible with a low material consumption and, in general, can be produced in a more rational manner.

22 Claims, 2 Drawing Sheets

U.S. PATENT DOCUMENTS

Figure 1:
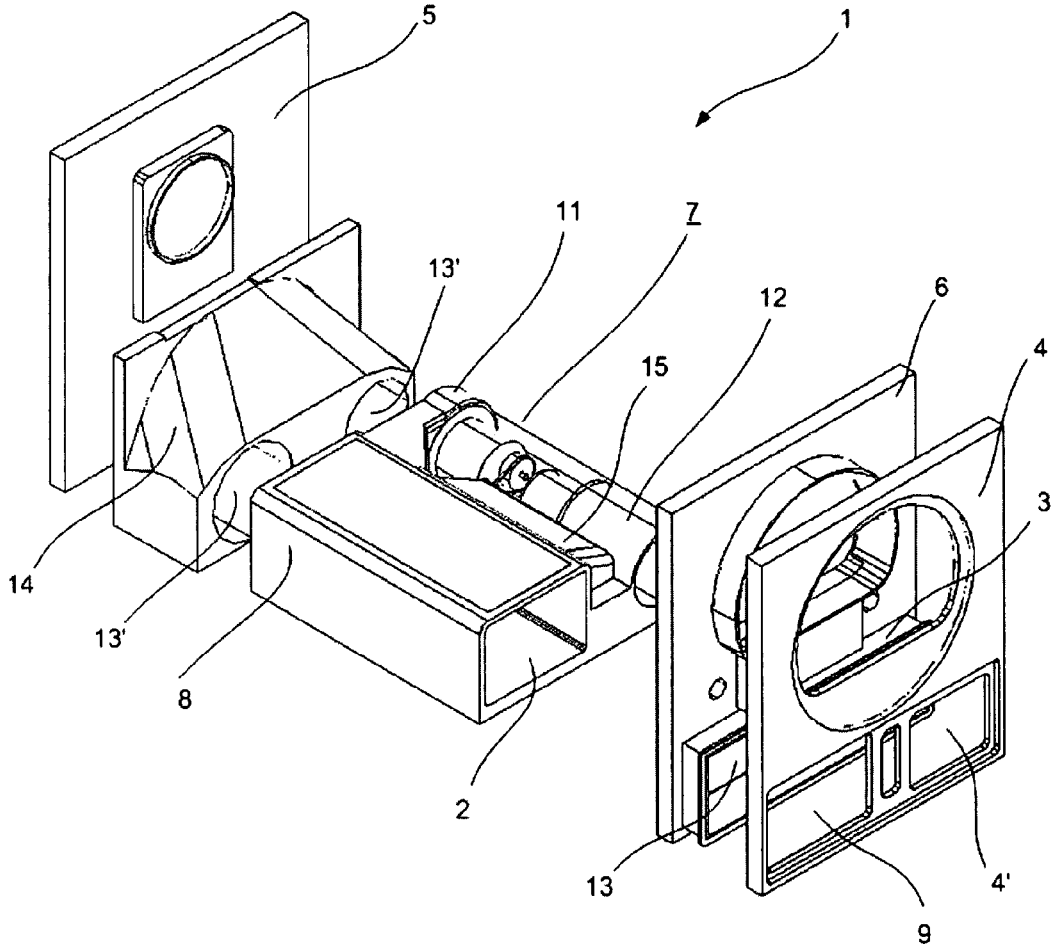

| | | | | | |
|---|---|---|---|---|---|
| 2,539,407 | A | * | 1/1951 | Dinley | 34/74 |
| 2,547,238 | A | * | 4/1951 | Tremblay | 34/603 |
| 2,553,581 | A | * | 5/1951 | Hatfield | 68/12.14 |
| 2,617,203 | A | * | 11/1952 | Murray | 34/82 |
| 2,619,736 | A | * | 12/1952 | Geldhof | 34/131 |
| 2,619,737 | A | * | 12/1952 | Geldhof et al. | 34/604 |
| 2,635,354 | A | * | 4/1953 | Geldhof et al. | 34/131 |
| 2,648,142 | A | * | 8/1953 | Shapter | 34/82 |
| 2,718,711 | A | * | 9/1955 | Clark | 34/75 |
| 2,722,750 | A | * | 11/1955 | Smith et al. | 34/82 |
| 2,728,481 | A | * | 12/1955 | Robinson et al. | 220/4.02 |
| 2,742,708 | A | * | 4/1956 | McCormick | 34/76 |
| 2,748,496 | A | * | 6/1956 | Hellyer | 34/603 |
| 2,751,688 | A | * | 6/1956 | Douglas | 34/82 |
| 2,778,124 | A | * | 1/1957 | Kauffman, II | 34/606 |
| 2,793,444 | A | * | 5/1957 | Turner | 34/602 |
| 2,812,593 | A | * | 11/1957 | Olthuis | 34/60 |
| 2,813,353 | A | * | 11/1957 | McMillan | 34/79 |
| 2,814,130 | A | * | 11/1957 | Cayot | 34/82 |
| 2,814,886 | A | * | 12/1957 | Fowler | 34/605 |
| 2,816,742 | A | * | 12/1957 | Richterkessing et al. | 366/228 |
| 2,817,157 | A | * | 12/1957 | McCormick | 34/82 |
| 2,853,798 | A | * | 9/1958 | Morrison | 34/75 |
| 2,855,698 | A | * | 10/1958 | Hutt | 34/108 |
| 2,865,111 | A | * | 12/1958 | Geldhof | 34/95 |
| 2,866,273 | A | * | 12/1958 | Geldhof | 34/75 |
| 2,868,004 | A | * | 1/1959 | Runde | 68/12.15 |
| 2,869,346 | A | * | 1/1959 | Brucken | 68/19.2 |
| 2,878,662 | A | * | 3/1959 | Brucken | 68/19.2 |
| 2,958,139 | A | * | 11/1960 | Smith | 34/604 |
| 2,958,954 | A | * | 11/1960 | Longenecker | 34/527 |
| 2,959,867 | A | * | 11/1960 | Doty | 34/82 |
| 2,983,050 | A | * | 5/1961 | Alaback | 34/90 |
| 3,023,514 | A | * | 3/1962 | Gibson | 34/589 |
| 3,027,653 | A | * | 4/1962 | Long et al. | 34/86 |
| 3,040,440 | A | * | 6/1962 | Mellinger et al. | 34/75 |
| 3,064,361 | A | * | 11/1962 | Turner | 34/91 |
| 3,066,422 | A | * | 12/1962 | Douglas | 34/82 |
| 3,102,008 | A | * | 8/1963 | Pansing et al. | 34/79 |
| 3,116,983 | A | * | 1/1964 | Chafee, Jr. | 34/527 |
| 3,152,876 | A | * | 10/1964 | Laing | 34/619 |
| 3,155,462 | A | * | 11/1964 | Erickson et al. | 34/82 |
| 3,161,481 | A | * | 12/1964 | Edwards | 34/527 |
| 3,163,029 | A | * | 12/1964 | Jacobs | 68/12.08 |
| 3,218,732 | A | * | 11/1965 | Alaback | 34/603 |
| 3,242,589 | A | * | 3/1966 | Jacobs | 34/595 |
| 3,254,423 | A | * | 6/1966 | Ruelle | 34/543 |
| 3,270,436 | A | * | 9/1966 | Fairgrieve | 34/131 |
| 3,270,761 | A | * | 9/1966 | Pansing | 137/88 |
| 3,277,583 | A | * | 10/1966 | Reinhold | 34/58 |
| 3,320,678 | A | * | 5/1967 | Berke | 34/82 |
| 3,388,567 | A | * | 6/1968 | Oles | 68/18 R |
| 3,399,464 | A | * | 9/1968 | Erickson et al. | 34/605 |
| 3,471,940 | A | * | 10/1969 | Smith | 34/603 |
| 3,487,556 | A | * | 1/1970 | Patrick | 34/601 |
| 3,543,408 | A | * | 12/1970 | Candor et al. | 34/250 |
| 3,555,701 | A | * | 1/1971 | Hubbard | 34/602 |
| 3,605,272 | A | * | 9/1971 | Boucher | 34/261 |
| 3,670,143 | A | * | 6/1972 | Zenz | 392/379 |
| 3,789,514 | A | * | 2/1974 | Faust et al. | 34/82 |
| 3,892,048 | A | * | 7/1975 | Jacobsen, Jr. | 34/604 |
| 3,969,070 | A | * | 7/1976 | Thompson | 432/105 |
| 4,088,017 | A | * | 5/1978 | Olges | 73/168 |
| 4,204,339 | A | * | 5/1980 | Muller | 34/75 |
| 4,207,683 | A | * | 6/1980 | Horton | 34/60 |
| 4,257,170 | A | * | 3/1981 | Gestblom et al. | 34/553 |
| 4,434,564 | A | * | 3/1984 | Braggins, Jr. | 34/86 |
| 4,481,786 | A | * | 11/1984 | Bashark | 62/160 |
| 4,586,269 | A | * | 5/1986 | St. Louis | 34/601 |
| 4,689,896 | A | * | 9/1987 | Narang | 34/82 |
| 4,700,495 | A | * | 10/1987 | Drews et al. | 34/603 |
| 4,720,925 | A | * | 1/1988 | Czech et al. | 34/82 |
| 4,817,297 | A | | 4/1989 | Toma et al. | |
| 4,889,642 | A | * | 12/1989 | Kaiser | 210/771 |
| 4,891,892 | A | * | 1/1990 | Narang | 34/86 |
| D314,261 | S | * | 1/1991 | Carr et al. | D32/25 |
| 5,072,526 | A | * | 12/1991 | Hirota et al. | 34/60 |
| 5,074,131 | A | * | 12/1991 | Hirose et al. | 68/19.2 |
| 5,207,764 | A | * | 5/1993 | Akabane et al. | 68/20 |
| 5,257,448 | A | * | 11/1993 | Pearce et al. | 29/434 |
| 5,343,632 | A | * | 9/1994 | Dinh | 34/507 |
| 5,388,348 | A | * | 2/1995 | Tanaka et al. | 34/499 |
| 5,404,865 | A | * | 4/1995 | Huls | 126/206 |
| 5,421,103 | A | * | 6/1995 | Wunderlich | 34/599 |
| 5,430,956 | A | * | 7/1995 | Lange | 34/408 |
| 5,454,171 | A | * | 10/1995 | Ikeda et al. | 34/492 |
| 5,477,623 | A | * | 12/1995 | Tomizawa et al. | 34/58 |
| 5,555,647 | A | * | 9/1996 | Torborg et al. | 34/601 |
| 5,619,614 | A | * | 4/1997 | Payne et al. | 706/1 |
| 5,666,739 | A | * | 9/1997 | Krueger | 34/86 |
| 5,887,456 | A | * | 3/1999 | Tanigawa et al. | 68/20 |
| 5,891,249 | A | * | 4/1999 | Bieler et al. | 118/420 |
| 5,906,056 | A | * | 5/1999 | Noguchi et al. | 34/596 |
| 6,122,843 | A | * | 9/2000 | Noguchi et al. | 34/596 |
| 6,381,874 | B1 | * | 5/2002 | Floyd | 34/602 |
| 6,766,596 | B1 | * | 7/2004 | Bienick et al. | 34/601 |
| 6,769,196 | B2 | * | 8/2004 | Park et al. | 34/77 |
| 6,792,695 | B2 | * | 9/2004 | Fry et al. | 34/597 |
| 6,938,356 | B2 | * | 9/2005 | Nagae et al. | 34/77 |
| 6,954,995 | B2 | * | 10/2005 | Kitamura et al. | 34/597 |
| 6,957,501 | B2 | * | 10/2005 | Park et al. | 34/446 |
| 6,968,632 | B2 | * | 11/2005 | Guinibert et al. | 34/602 |
| 6,971,189 | B1 | * | 12/2005 | Anibas | 34/602 |
| 6,981,336 | B2 | * | 1/2006 | Nagae et al. | 34/77 |
| 7,020,986 | B1 | * | 4/2006 | Nakai et al. | 34/596 |
| 7,024,795 | B2 | * | 4/2006 | Tadano et al. | 34/76 |
| 7,043,855 | B2 | * | 5/2006 | Heilman et al. | 34/389 |
| 7,065,905 | B2 | * | 6/2006 | Guinibert et al. | 34/603 |
| 7,069,669 | B2 | * | 7/2006 | Park et al. | 34/603 |
| 7,117,613 | B2 | * | 10/2006 | Guinibert et al. | 34/534 |
| 7,146,749 | B2 | * | 12/2006 | Barron et al. | 34/596 |
| 7,225,562 | B2 | * | 6/2007 | Guinibert et al. | 34/601 |
| 7,251,906 | B2 | * | 8/2007 | Kajihara et al. | 34/603 |
| 7,257,905 | B2 | * | 8/2007 | Guinibert et al. | 34/82 |
| 7,409,776 | B2 | * | 8/2008 | Ono et al. | 34/77 |
| 7,412,783 | B2 | * | 8/2008 | Guinibert et al. | 34/572 |
| 7,415,781 | B2 | * | 8/2008 | Barron et al. | 34/595 |
| 7,425,688 | B2 | * | 9/2008 | Loesch et al. | 219/400 |
| 7,444,761 | B2 | * | 11/2008 | Gray | 34/340 |
| 7,467,483 | B2 | * | 12/2008 | Guinibert et al. | 34/601 |
| 7,503,127 | B2 | * | 3/2009 | DuVal et al. | 34/381 |
| 7,627,960 | B2 | * | 12/2009 | Beyerle et al. | 34/602 |
| 7,644,515 | B2 | * | 1/2010 | Doh | 34/603 |
| 7,661,203 | B2 | * | 2/2010 | Fumagalli | 34/596 |
| 7,762,007 | B2 | * | 7/2010 | Guinibert et al. | 34/601 |
| 2002/0069465 | A1 | * | 6/2002 | Chute et al. | 8/158 |
| 2003/0089138 | A1 | * | 5/2003 | Kawamura et al. | 68/17 R |
| 2003/0200674 | A1 | * | 10/2003 | Fry et al. | 34/597 |
| 2004/0035019 | A1 | * | 2/2004 | Park et al. | 34/73 |
| 2004/0064970 | A1 | * | 4/2004 | Hagemann et al. | 34/597 |
| 2004/0068889 | A1 | * | 4/2004 | Park et al. | 34/446 |
| 2004/0123489 | A1 | * | 7/2004 | Pancheri et al. | 34/597 |
| 2004/0123490 | A1 | * | 7/2004 | Pancheri et al. | 34/597 |
| 2004/0134090 | A1 | * | 7/2004 | Heilman et al. | 34/209 |
| 2004/0143994 | A1 | * | 7/2004 | Baron et al. | 34/597 |
| 2004/0216326 | A1 | * | 11/2004 | Kitamura et al. | 34/597 |
| 2004/0221478 | A1 | * | 11/2004 | Lee et al. | 34/603 |
| 2004/0221479 | A1 | * | 11/2004 | Lee et al. | 34/603 |
| 2005/0044744 | A1 | * | 3/2005 | Tadano et al. | 34/596 |
| 2005/0047063 | A1 | | 3/2005 | Bolduan et al. | |
| 2005/0072022 | A1 | * | 4/2005 | Nagae et al. | 34/596 |
| 2005/0076532 | A1 | * | 4/2005 | Ward et al. | 34/597 |
| 2005/0076535 | A1 | * | 4/2005 | Guinibert et al. | 34/601 |
| 2005/0086827 | A1 | * | 4/2005 | Nagae et al. | 34/218 |
| 2005/0091879 | A1 | * | 5/2005 | DuVal et al. | 34/597 |
| 2005/0102852 | A1 | * | 5/2005 | Mizhari | 34/130 |
| 2005/0115104 | A1 | * | 6/2005 | Guinibert et al. | 34/601 |
| 2005/0198851 | A1 | * | 9/2005 | Tomochika et al. | 34/74 |
| 2005/0198852 | A1 | * | 9/2005 | Ono et al. | 34/77 |
| 2005/0252032 | A1 | * | 11/2005 | Park et al. | 34/604 |
| 2005/0252033 | A1 | * | 11/2005 | Loesch et al. | 34/604 |
| 2006/0037213 | A1 | * | 2/2006 | Kajihara et al. | 34/596 |
| 2006/0080974 | A1 | * | 4/2006 | Ono et al. | 62/93 |
| 2006/0162180 | A1 | * | 7/2006 | Heilman et al. | 34/389 |
| 2007/0006477 | A1 | * | 1/2007 | Guinibert et al. | 34/85 |
| 2007/0094888 | A1 | * | 5/2007 | Barron et al. | 34/597 |
| 2007/0186440 | A1 | * | 8/2007 | Guinibert et al. | 34/603 |

| | | | | |
|---|---|---|---|---|
| 2007/0204480 | A1 * | 9/2007 | Gray | 34/410 |
| 2007/0220776 | A1 * | 9/2007 | Guinibert et al. | 34/603 |
| 2008/0022551 | A1 * | 1/2008 | Banta et al. | 34/602 |
| 2008/0034611 | A1 * | 2/2008 | Carow et al. | 34/565 |
| 2008/0104862 | A1 * | 5/2008 | Dittmar et al. | 34/601 |
| 2008/0120868 | A1 * | 5/2008 | Morrison et al. | 34/572 |
| 2008/0163510 | A1 * | 7/2008 | Dittmar et al. | 34/108 |
| 2008/0189974 | A1 * | 8/2008 | Dittmer et al. | 34/132 |
| 2008/0196268 | A1 * | 8/2008 | Jung et al. | 34/603 |
| 2009/0282694 | A1 * | 11/2009 | Magennis et al. | 34/337 |
| 2010/0000112 | A1 * | 1/2010 | Carow et al. | 34/357 |
| 2010/0000114 | A1 * | 1/2010 | Dalton et al. | 34/389 |
| 2011/0016643 | A1 * | 1/2011 | DuVal et al. | 8/442 |

FOREIGN PATENT DOCUMENTS

| | | | |
|---|---|---|---|
| DE | 3203632 | A1 * | 8/1983 |
| DE | 40 31 223 | | 4/1992 |
| DE | 41 39 588 | | 6/1992 |
| DE | 43 27 916 | | 2/1994 |
| DE | 4327916 | A1 * | 2/1994 |
| DE | 4422000 | A1 * | 1/1996 |
| DE | 19508244 | A1 * | 9/1996 |
| DE | 102 02 442 | | 8/2003 |
| EP | 22044 | A1 * | 1/1981 |
| EP | 59801 | A1 * | 9/1982 |
| EP | 0 183 176 | | 6/1986 |
| EP | 356689 | A1 * | 3/1990 |
| EP | 0 481 187 | | 4/1992 |
| EP | 575759 | A1 * | 12/1993 |
| EP | 588100 | A1 * | 3/1994 |
| EP | 0 950 749 | | 10/1999 |
| EP | 1209277 | A2 * | 5/2002 |
| EP | 1391550 | A1 * | 2/2004 |
| EP | 1524359 | A1 * | 4/2005 |
| GB | 2 114 723 | | 8/1983 |
| JP | 01022300 | A * | 1/1989 |
| JP | 01223997 | A * | 9/1989 |
| JP | 02029298 | A * | 1/1990 |
| JP | 02213392 | A * | 8/1990 |
| JP | 02261500 | A * | 10/1990 |
| JP | 04035697 | A * | 2/1992 |
| JP | 04097791 | A * | 3/1992 |
| JP | 05123499 | A * | 5/1993 |
| JP | 06218192 | A * | 8/1994 |
| JP | 06339596 | A * | 12/1994 |
| JP | 07275586 | A * | 10/1995 |
| JP | 09024194 | A * | 1/1997 |
| JP | 09108497 | A * | 4/1997 |
| JP | 10015299 | A * | 1/1998 |
| JP | 10033896 | A * | 2/1998 |
| WO | WO 9207989 | A1 * | 5/1992 |
| WO | WO 47810 | A1 * | 8/2000 |

* cited by examiner

CLOTHES DRYER

The invention relates to a clothes drying machine, especially a condensation clothes dryer, with a clothes drum that can be rotated about an at least approximately horizontal axis and that can be actuated electrically, with functional parts for conveying and with components for routing the process air and the cooling air, with a heating device for the process air, and with a support structure that stabilizes the machine mechanically, and also with modular units suitable for receiving the functional parts and components of the air routing system.

In the case of known clothes drying machines—designated as clothes dryers in the following—the support structure consists of a housing implemented in a self-supporting construction design, the housing wall parts thereof being bolted to each other. Additional stabilizing strips and guide rails are present for the purposes of receiving the operationally necessary functional assembly groups and built-in parts.

For reasons of space, most functional parts necessary for operation and devices for routing the process and cooling air are integrated in a compact module and permanently connected to the frame as a bottom part underneath the clothes drum. The heating device for the process air is normally arranged on the rear wall of the drum and the fluff filter necessarily present in the case of condensation clothes dryers in the area of the loading aperture where it is easily accessible for the user.

A number of aspects have to be taken into account and where relevant balanced against each other in the design of a clothes dryer. Alongside a sufficient level of mechanical stability, the functional assembly groups and built-in parts have to be realized and arranged with respect to each other in such a way that not only is their function safeguarded but the most effective possible operation is also achievable. Manufacturing technology and economic issues have to be taken into account with reference to the production of such clothes dryers.

A uniform base frame that is capable of being used equally for washing machines and dryers is described in DE 40 31 223 A1. The base frame contains a bottom and two side walls and is stamped from one piece. Means for the insertion and the fixing of an additional bottom are provided in the area of the bottom. A trough is formed in the bottom by means of raised wall parts at its front and rear edges, into which trough the additional bottom is inserted. The additional bottom is provided with raised edges on all sides and fitted into the trough. The additional bottom, which is stable in itself due to the raised edges, is permanently connected to the base frame after insertion into the trough. A high level of stability of the dryer housing is achieved by means of this sandwich construction design and the raised edges of the additional bottom.

The solution described is directed exclusively at the stability of the housing. A frame design of this type is very costly in terms of materials and processing.

A clothes drying machine that is modular in construction as described in the introduction is presented in DE 41 39 588 A1. In said clothes drying machine, individual modules—a bottom group, a front wall group, a housing group, and the drying unit—are pre-assembled with the functional parts and components and finished off and joined together with further individual parts in the final assembly stage. The assembly effort in the final manufacturing stage is considerably reduced as a result of this. A further advantage consists in the fact that the assembly groups joined together in the final assembly stage are pre-inspected.

The concept underlying the clothes dryer described is largely technologically driven. The production of the dryer is made more efficient by shifting fundamental work operations relating to the assembly and inspection of the individual components into the pre-manufacturing stage. Additionally, the defect level should be lowered since only pre-inspected assembly groups and functional parts are joined together in the final assembly stage.

The support structure contains the usual reinforcing elements at the corners and in the bottom area and is put together from individual components, which are broken down in line with the construction of the individual modules. Nevertheless, the handling of the modules during the joining together and connecting in the final assembly stage requires a not inconsiderable effort.

A self-supporting bottom module is known from DE 31 35 292 C2. The bottom assembly group described in same is constructed from a plinth part, an intermediate bottom, and a top part, which form the support body when arranged one above the other. The receiving facilities for the functional parts and for devices for the routing of the process and cooling air are molded in this compact support body made of plastic. The bottom assembly group is part of the support body of the machine and replaces the cross struts and retaining rails otherwise customary in the bottom area. The dryer housing is supported on the plinth part, in which corner posts are molded for the purposes of receiving the housing wall mounting element.

The known combination of metal frame and plastic bottom part is very material-intensive and has disadvantages during the connection of the support body and the fan ducts.

Support structures in which the stability is fundamentally produced by means of corner profiles braced with respect to each other or the edge areas, especially of the rear and the front walls, shaped as profiles are very material-intensive and/or costly in terms of processing. Disadvantages also arise in the production of the dryers from the quantity of individual manufacturing parts and as a result of the fact that the assembly technology that has to be applied for installing the functional assembly groups and for finishing off the dryers is to some extent restricted by elements of the support structure. An example of a braced design is shown in DE 41 39 588 A1.

U.S. Pat. No. 4,817,297 describes a support structure for a clothes dryer that supports a plurality of functions and makes a dryer assembly process easier. The dryer includes a drum, a plate that supports the end of the drum directed toward the open front, and a housing with a front plate that is spaced from the open end of the drum. A one-piece intermediate element spans the front plate and the drum, an aperture existing in the intermediate element between an access aperture in the front plate and the open front end of the drum. The intermediate element also supports a filter in alignment with part of the drum aperture.

The solutions described in the foregoing moreover share the disadvantage that the interfaces of the process air routing system have to be provided with additional seals to prevent losses and the escape of moisture.

The object underlying the invention is to specify a support structure for a clothes drying machine of the type referred to in the introduction, which, while the necessary stability is ensured, has an improved economic basis in terms of materials compared with the known clothes dryers and enables a more efficient manufacturing and assembly of the clothes dryer as a whole, particularly by reducing the individual construction parts that have to be assembled in the final manufacturing stage and simplifying the joining processes.

The design concept according to the invention provides that the modular units for receiving the functional parts and components of the air routing system are at the same time realized as parts of the support structure. The support structure for stabilizing the clothes dryer is preferably essentially formed from a front combined body consisting of the front wall and the end shield, a rear wall with the heating device, and a base module base body connecting the two modular units. The end shield and base module base body are manufactured from plastic and shaped for receiving the functional parts and the air routing system devices.

The interfaces or joining surfaces between the base module base body and the end shield and also the base module base body and a process air lid lie in a vertical plane. All the joining surfaces are as large as possible and extend across the entire width of the clothes dryer.

Together with the specific shaping of the individual construction parts, particularly by means of molded stiffening elements and ribs, and an adapted connecting technique, welding of the base module base body and the process air lid, and also latching and bolting of the front-side combined body to the end shield, the clothes dryer is given such a high level of stiffness as a whole that the usual support structures, formed from vertical corner pillars and stiffening horizontal support angle brackets and rails, are not required. The connections are produced without the otherwise usual seals at the joining points.

The quantity of individual parts that have to be used and assembled as a whole is considerably reduced by the support structure according to the invention. Compared with the known embodiments described in the foregoing, the proposed design can be implemented for a clothes dryer with lower use of materials, the appliance becomes lighter as a whole, and it can be manufactured more efficiently.

Fundamental advantages also arise from the support structure according to the invention during the assembly of the dryer. The front wall, end shield, and base module base body can be populated with and connected to the functional units necessary for operation, control and communication with the user in the pre-manufacturing stage. The quantity of individual parts or modular units that have to be assembled in the final manufacturing stage is therefore restricted to a minimum. It is also advantageous that the joining together of the main constituents of the support structure created and pre-assembled in accordance with the invention can be effected in one direction of assembly.

Figure 2:
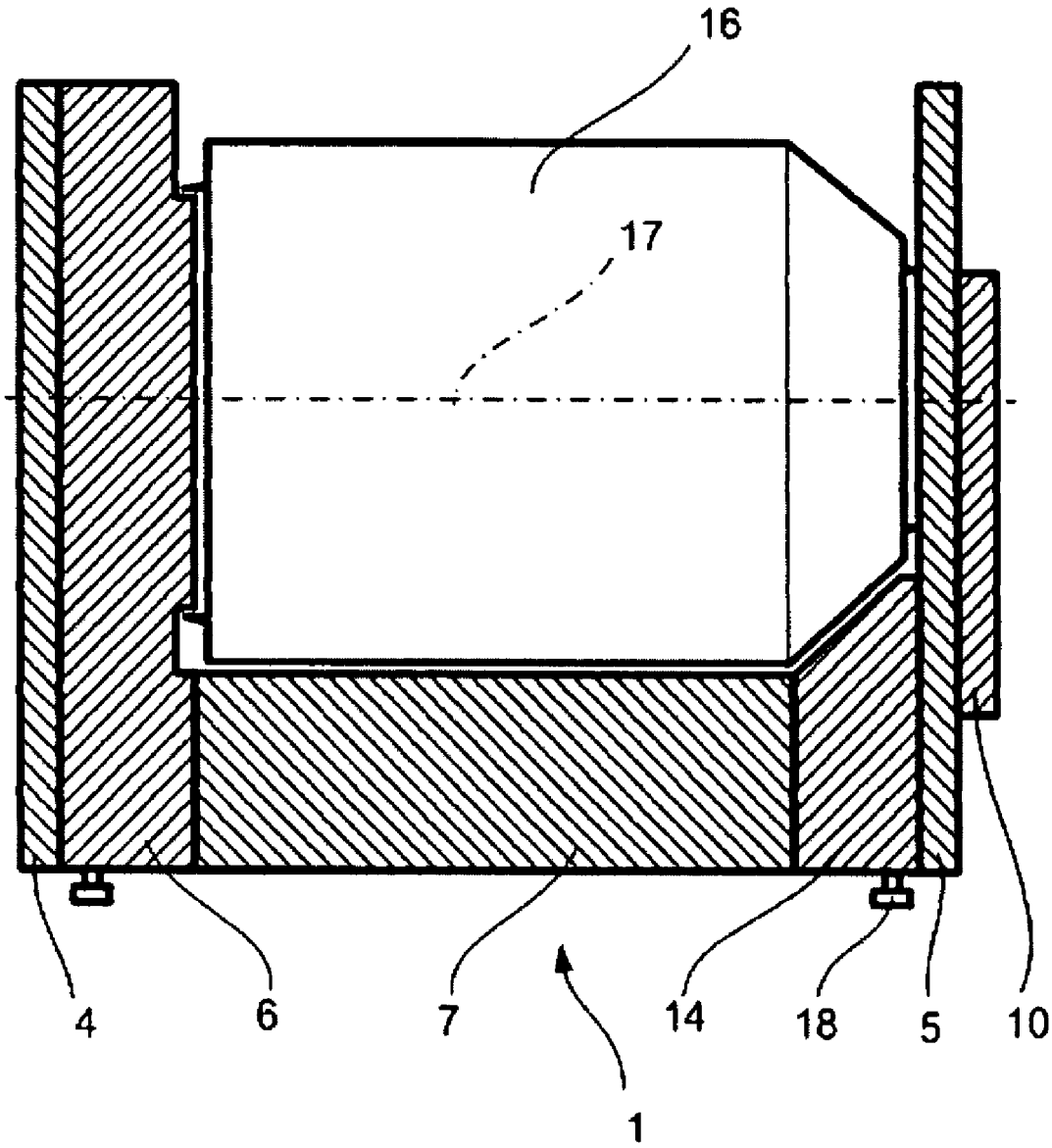

In the following, the invention, together with further advantageous embodiments, is explained in detail on the basis of an exemplary embodiment. In the associated drawings, FIG. 1 shows the modular construction of a clothes dryer, and FIG. 2 shows the schematically represented support structure of the clothes dryer.

The end shield 6 is adapted to the front wall 4 in shape and size. Permanently joined to each other in any desired way, the front wall 4 and the end shield 6 form a combined body that is stable in itself. The end shield 6, to which support rollers (not shown) for a clothes drum 16 are fixed, is shaped as a process air duct 13 in the lower area. A fluff filter 3 is arranged directly at the entrance of the process air duct 13 that is formed by the end shield 6 and that tapers from the top. The fluff filter 3 can be taken out via the loading aperture and is easily accessible, when the loading door (not shown) is open, for the user for cleaning purposes. The front wall 4 has in its lower area an aperture 9 for access to the heat exchanger, which is arranged in the condenser cavity 2, and an air intake 4' for the cooling air blower 12.

The base module base body 7 is a compact plastic body that is resistant to bending and torsion, in which a condensate collecting tray, air guiding and routing devices and the casing 8 with the condenser cavity 2 for a heat exchanger, a condensate delivery pump, a drive motor, and fan wheels for the process and the cooling air blowers 11, 12, and also ducts 13', 15 for the process air and the cooling air are molded in a manner that is not shown in detail. The base module base body 7 and the process air lid 14 are welded to each other. Stiffening ribs are molded in both parts for the purposes of increasing the strength. The rear module consisting of the rear wall 5 and the heating element 10, and also process air guiding devices, is bolted to the process air lid 14 stretching across the entire width of the clothes dryer 1.

All the joining processes are carried out one after another in a horizontal plane and in one direction from the front, which has the effect of enhancing efficiency during the manufacturing. On the front side, the combined body consisting of the front wall 4 and the end shield 6 is latched and subsequently bolted, for example, initially to the base module base body 7. A latched connection between the combined body 4, 6 and the base module base body 7 is sufficiently stable to keep the two construction parts securely positioned during the further manufacturing sequence even without additional ancillary devices. The connection gains its particular strength due to bolt fastenings, which connect the front plate to the base part right through the end shield. The bolting of the combined body 4, 6 to the base module base body 7 is similarly effected from the front.

With regard to the work to be carried out for the purposes of finishing off the clothes dryer 1 in the final assembly stage, it is advantageous that the L-shaped combined body consisting of the front wall 4, end shield 6, and base module base body 7 is freely accessible from above and from the sides. The manual actions that necessarily have to be carried out are not restricted by struts or rails that stiffen the housing. This brings with it an advantage due to which the opportunities for efficient assembly technologies are expanded.

The front wall 4 and the rear wall 5 are made of sheet metal and folded once at the edges. These folded edges are usually used for stability and also as a contact surface and for the purposes of fixing the side walls. The external configuration of the clothes dryer 1 is finished off by means of a covering plate placed on top, which is not shown in the drawings.

For the purposes of a better understanding of the essential nature of the solution according to the invention, the arrangement of the main modular units and their joining lines are shown in a simplified and strongly schematic manner in a vertical section along the center axis 17 of the clothes drum 16 in FIG. 2. The spatial extension of the front wall 4 and the end shield 6 on the one side and the rear wall 5 together with the process air lid 14 stretches to the bottom surface and across the entire width of the clothes dryer 1; the respective interfaces to the base module base body 7 are realized in very large form in comparative terms and lie in a vertical plane or in a stepped back vertical plane transverse to the center axis 17 of the clothes drum 16. This alignment and the size of the interfaces enable a very secure connection of the end shield 6 and also of the process air lid 14 to the base module base body 7 and their technologically simple assembly.

Even without the frame profiles that are usual in accordance with the state of the art or without known profiles molded in the edge area of the wall sheets, the support structure according to the invention has a sufficiently high level of stability so that the machine can withstand all the relevant force effects during operation and transport without damage.

REFERENCE SYMBOLS

1 Clothes dryer
2 Condenser cavity
3 Fluff filter
4 Front wall
4' Air intake
5 Rear wall
6 End shield
7 Base module base body
8 Condenser housing
9 Heat exchanger insertion aperture
10 Heating device
11 Process air blower
12 Cooling air blower
13 Process air duct
13' Process air duct
14 Process air lid
15 Cooling air duct
16 Clothes drum
17 Center axis
18 Supporting feet

The invention claimed is:

1. A clothes drying machine comprising:

a clothes drum being rotatable about a substantially horizontal axis and that can be actuated electrically;

an air routing system including functional parts for conveying process air and cooling air within the drying machine and with components for routing the process air and the cooling air;

a heating device heating the process air;

a support structure that stabilizes the machine mechanically, the support structure being defined by modular units receiving the functional parts and components of the air routing system;

the modular units being pre-assembled and including:

a front module in the form of a combined body made up of an end shield and a front wall;

a base module on a bottom side including a base body and a process air lid; and a rear module including a rear wall, the heating device, and a cover.

2. The clothes drying machine as claimed in claim 1, wherein joining surfaces of the front module and of the base module base body on the one side, and also of the process air lid and of the base module base body on the other side are connected to each other without the use of sealing elements.

3. The clothes drying machine as claimed in claim 2, wherein the joining surfaces between the base module base body on the bottom side and the front module in the form of a combined body, and also the joining surfaces between the base module base body and the process air lid essentially lie in a vertical plane or in stepped back vertical planes in each case.

4. The clothes drying machine as claimed in claim 3, wherein all the portions of the support structure are joined to each other in a horizontal joining direction.

5. The clothes drying machine as claimed in claim 2, wherein the base module base body is permanently connected to the front module.

6. The clothes drying machine as claimed in claim 5, wherein the base module base body is permanently connected to the front module with at least one of latching and bolting.

7. The clothes drying machine as claimed in claim 5, wherein the front wall, the end shield, and the base module base body are attached to each other by means of through-bolting.

8. The clothes drying machine as claimed in claim 2, wherein the end shield, the base module base body, and the process air lid are plastic parts.

9. The clothes drying machine as claimed in claim 8, wherein the base module base body is permanently connected to the process air lid at the back.

10. The clothes drying machine as claimed in claim 9, wherein the base module base body is permanently connected to the process air lid at the back by means of welding.

11. The clothes drying machine as claimed in claim 1, wherein all the modular units of the support structure extend across the entire width of the clothes drying machine, such that joining surfaces similarly extend across the width of the clothes drying machine.

12. The clothes drying machine as claimed in claim 8, wherein supporting feet are molded in the process air lid.

13. The clothes drying machine as claimed in claim 8, wherein stiffening elements and ribs are molded in the base module base body and in the process air lid in the bottom surface and in the side surfaces.

14. The clothes drying machine as claimed in claim 1, wherein the clothes drying machine is a condensation clothes dryer.

15. A clothes drying machine comprising:

a pre-assembled front module including a front wall and an end shield, wherein the end shield is adapted to the front wall in shape and size;

a pre-assembled base module including a plastic base body and a process air lid welded to the plastic base body, the base module including an air routing system that conveys process air and cooling air within the machine;

a pre-assembled rear module including a rear wall and a heating element, wherein the front module includes at least one opening for receiving a front part of the air routing system, and wherein the rear module is secured to the process air lid; and a clothes drum rotatably supported on the base module between the front module and the rear module and cooperable with the air routing system.

16. The clothes drying machine as claimed in claim 15, wherein joining surfaces between the front module, the base module and the rear module extend across an entire width of the clothes dryer.

17. The clothes drying machine as claimed in claim 15, wherein joining surfaces of the front module and of the base module on the one side, and also of the process air lid and of the base module on the other side are connected to each other without the use of sealing elements.

18. The clothes drying machine as claimed in claim 15, wherein the clothes drum is rotatable about a substantially horizontal axis, and wherein the clothes drum is actuated electrically.

19. The clothes drying machine as claimed in claim 15, wherein the air routing system comprises functional parts for conveying the process air and the cooling air and with components for routing the proess air and the cooling air.

20. A clothes drying machine comprising:

a pre-assembled front module including a front wall and an end shield, wherein the end shield is adapted to the front wall in shape and size;

a pre-assembled base module including a plastic base body and a process air lid welded to the plastic base body, the base module including an air routing system that conveys process air and cooling air within the machine;

a pre-assembled rear module including a rear wall and a heating element, wherein the front module includes at least one opening for receiving a front part of the air routing system, and wherein the rear module is secured to the process air lid; and a clothes drum rotatably supported on the base module between the front module and the rear module and cooperable with the air routing system, wherein the clothes drum is rotatable about a substantially horizontal axis, and wherein the clothes drum is actuated electrically, and wherein the air routing system comprises functional parts for conveying the process air and the cooling air and with components for routing the process air and the cooling air.

21. The clothes drying machine as claimed in claim 1, wherein the base module is connected to the front module to define an L-shaped combined body, and wherein the L-shaped combined body comprises a stable self-supporting unit.

22. The clothes drying machine as claimed in claim 21, wherein the L-shaped combined body is constructed so as to be freely accessible from above and from sides thereof prior to final assembly of the clothes drying machine.

* * * * *